US012788096B2

(12) United States Patent
Darrow

(10) Patent No.: US 12,788,096 B2
(45) Date of Patent: Nov. 10, 2026

(54) GOGGLES THAT ARE REVERSIBLY MAGNETICALLY ATTACHABLE TO A HELMET

(71) Applicant: Stephan M Darrow, Lincoln, CA (US)

(72) Inventor: Stephan M Darrow, Lincoln, CA (US)

( * ) Notice: Subject to any disclaimer, the term of this patent is extended or adjusted under 35 U.S.C. 154(b) by 0 days.

(21) Appl. No.: 19/175,289

(22) Filed: Apr. 10, 2025

(65) Prior Publication Data

US 2026/0314739 A1 Oct. 15, 2026

(51) Int. Cl.
*A42B 3/18* (2006.01)

(52) U.S. Cl.
CPC ..... *A42B 3/185* (2013.01)

(58) Field of Classification Search
CPC ..... A42B 3/125; A61F 9/02
See application file for complete search history.

(56) References Cited

U.S. PATENT DOCUMENTS

| | | | | |
|---|---|---|---|---|
| 10,517,345 | B2 * | 12/2019 | Luo | A42B 1/248 |
| 11,129,431 | B2 * | 9/2021 | Whitesell | A42B 3/185 |
| 2024/0292920 | A1 * | 9/2024 | Llopis Llinares | A42B 3/185 |

* cited by examiner

*Primary Examiner* — Katherine M Moran
(74) *Attorney, Agent, or Firm* — Craig A. Simmermon

(57) ABSTRACT

Goggles that are reversibly magnetically attachable to a helmet are special goggles for eye protection that are reversibly magnetically attachable to a helmet. Specifically, goggles that are reversibly magnetically attachable to a helmet are a three-piece assembly of a special goggle and two metallic temple plates that are rigidly attached to a helmet. The special goggle has two specially shaped magnets rigidly attached thereto. The two metallic temple plates each have a special shape. The two metallic temple plates are each rigidly attached to a helmet at specific locations. The goggles are then reversibly magnetically attachable to the two metallic temple plates. A helmet is not necessarily a part of the invention but a helmet is included in the invention with certain embodiments.

2 Claims, 12 Drawing Sheets

GOGGLES THAT ARE REVERSIBLY MAGNETICALLY ATTACHABLE TO A HELMET

BACKGROUND OF THE INVENTION

1. Field of the Invention

This invention relates to special goggles for eye protection that are reversibly magnetically attachable to a helmet. Specifically, this invention is a three-piece assembly of a special goggle and two metallic temple pieces that are rigidly attached to a helmet. A helmet is not necessarily a part of the invention but a helmet is included in the invention with certain embodiments. Many sports and recreational activities require the participant to wear a protective helmet and protective goggles, such as motor sports, aviation sports, winter sports, water sports, skydiving, etc. Also, goggles are commonly used in chemistry laboratories and in woodworking. Goggles are often worn when using power tools such as drills or chainsaws to prevent flying particles from damaging the eyes. This invention allows for the user to quickly put on goggles in a very secure fashion and quickly take them off without the use of a strap running over the helmet which inevitably causes problems. Thus, this invention allows for goggles to be put on and taken off without the use of a strap on the goggles.

2. Description of Related Art

There are no goggles that are reversibly magnetically attachable to a helmet in the prior art, and, in any event, there are none that include the special three-piece assembly as described here which includes a specially designed goggle that is fitted with two magnets along with two specially shaped metallic temple pieces that are rigidly attached to a helmet as described below. The three-piece assembly is the goggle and the two metallic temple pieces as described below.

BRIEF SUMMARY OF THE INVENTION

It is an aspect of goggles that are reversibly magnetically attachable to a helmet to include a special goggle with a specially shaped left magnet that is rigidly attached to the special goggle.

It is an aspect of specially shaped left magnet to include a portion that is parallelepiped, rectangular prism, or cuboid shaped.

It is an aspect of goggles that are reversibly magnetically attachable to a helmet to include a special goggle with a specially shaped right magnet that is rigidly attached to the special goggle.

It is an aspect of specially shaped right magnet to include a portion that is parallelepiped, rectangular prism, or cuboid shaped.

It is an aspect of goggles that are reversibly magnetically attachable to a helmet to include a specially shaped left temple plate that is rigidly attachable to a helmet.

It is an aspect of specially shaped left temple plate to include a rigid planar ferromagnetic member attached to an arced, curved, or partial spherically shaped ferromagnetic member.

It is an aspect of goggles that are reversibly magnetically attachable to a helmet to include a specially shaped right temple plate that is rigidly attachable to a helmet.

It is an aspect of specially shaped right temple plate to include a rigid planar ferromagnetic member attached to an arced, curved, or partial spherically shaped ferromagnetic member.

It is an aspect of special goggle to be reversibly magnetically attachable to the left temple plate.

It is an aspect of special goggle to be reversibly magnetically attachable to the right temple plate.

DEFINITION LIST

Figure 1:
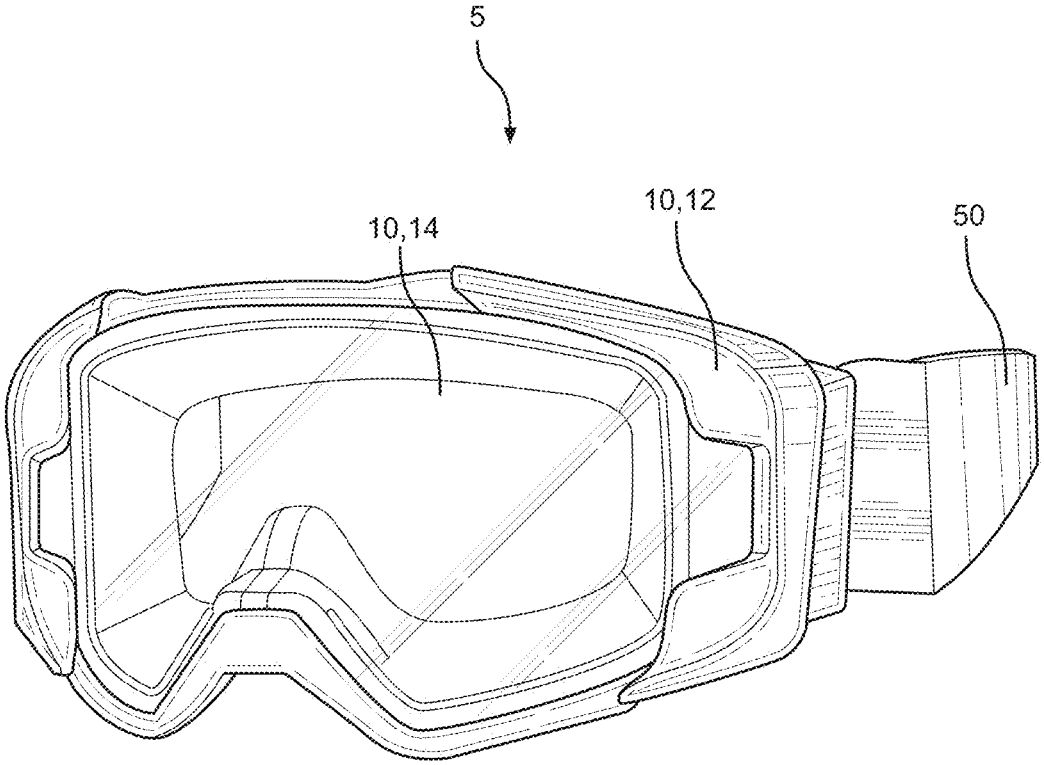
FIG. 1 is a front perspective view of goggles that are reversibly magnetically attachable to a helmet.
Figure 2:
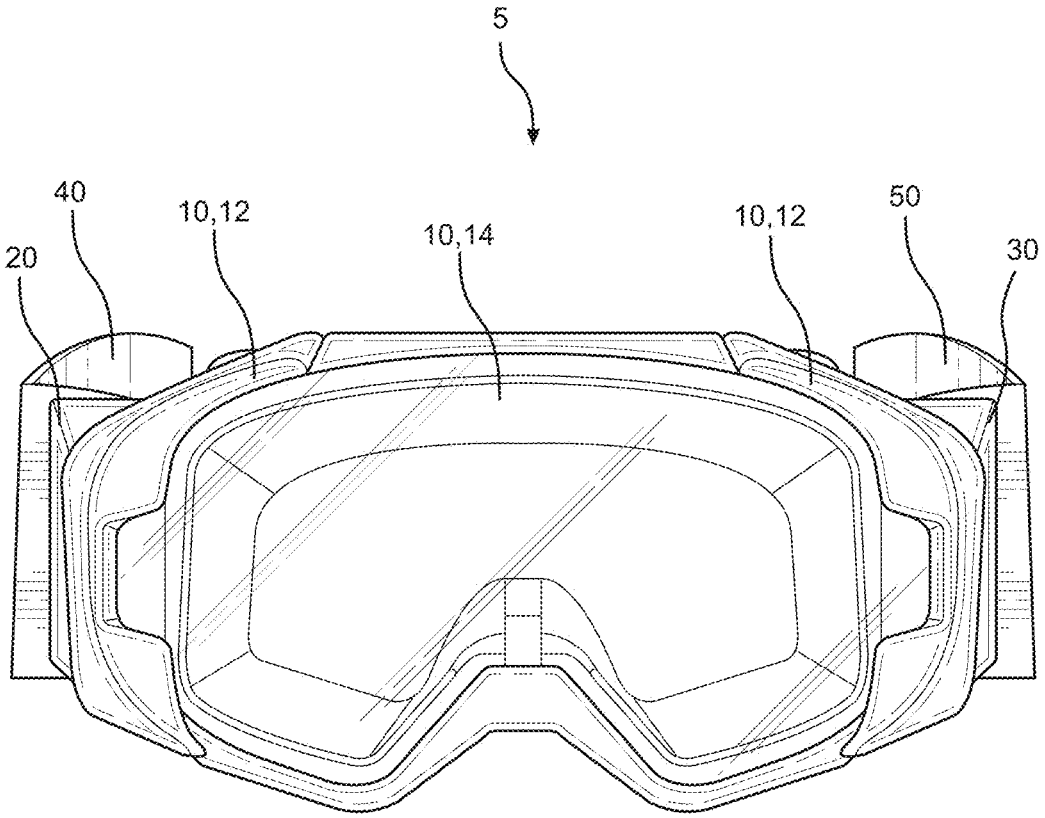
FIG. 2 is a front elevation view of goggles that are reversibly magnetically attachable to a helmet.
Figure 3:
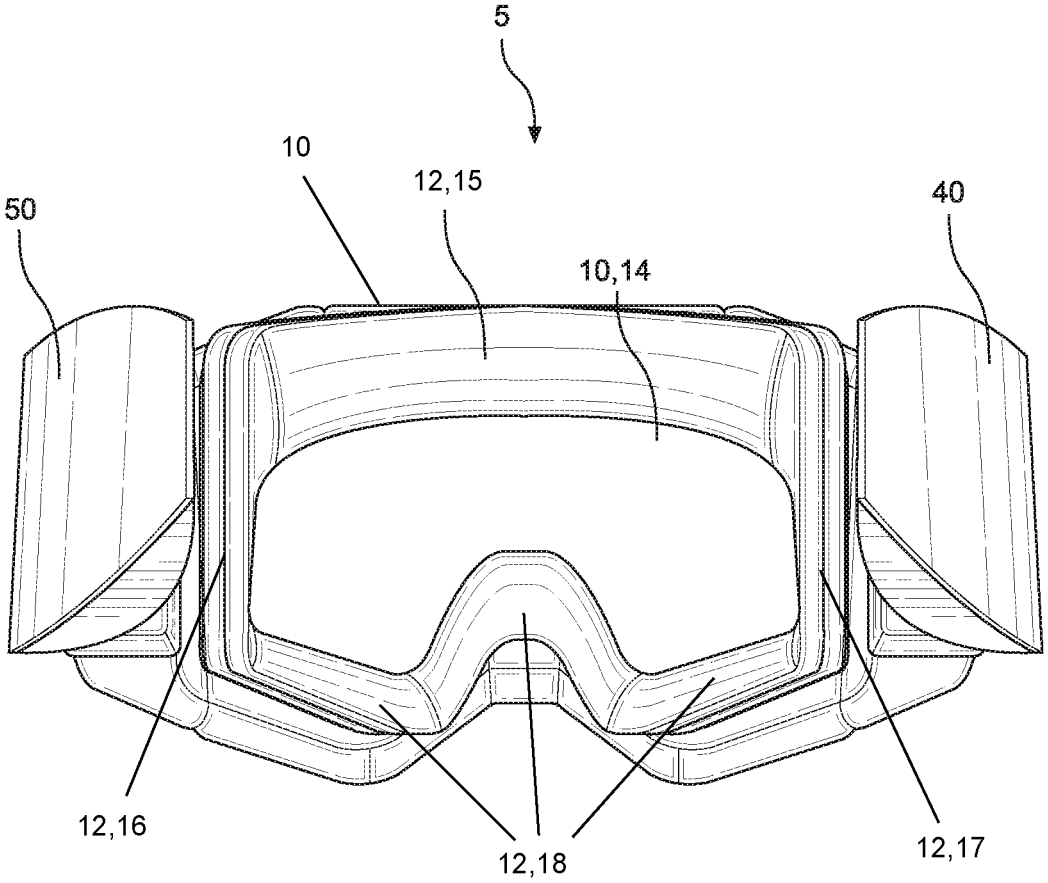
FIG. 3 is a rear elevation view of goggles that are reversibly magnetically attachable to a helmet.
Figure 4:
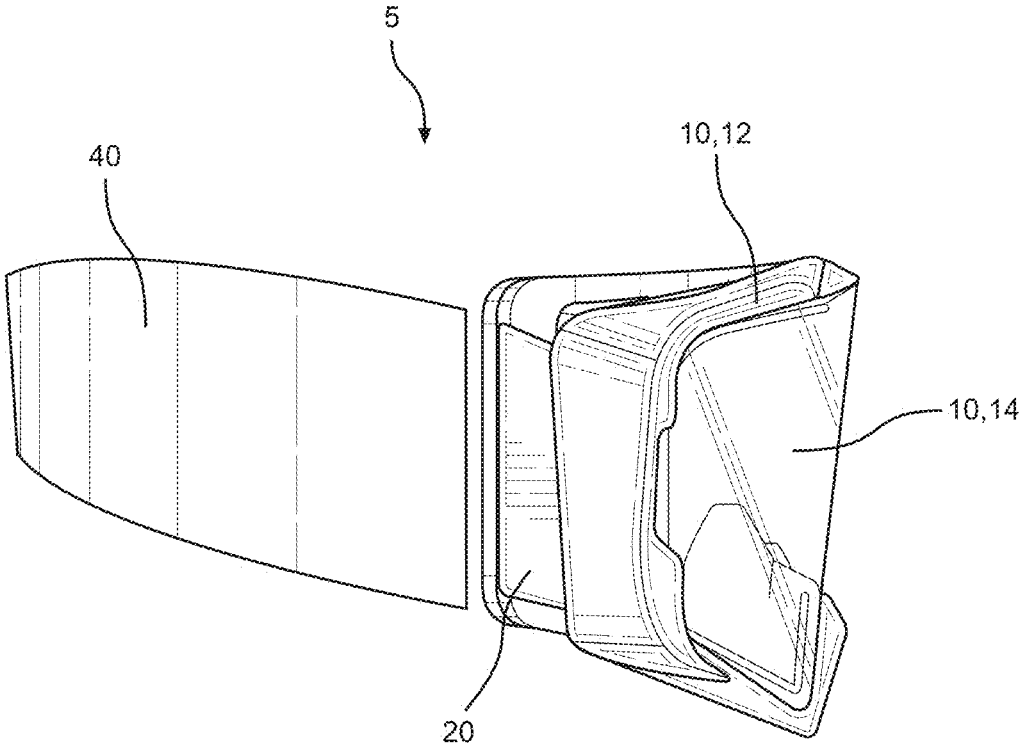
FIG. 4 is a right side elevation view of goggles that are reversibly magnetically attachable to a helmet.
Figure 5:
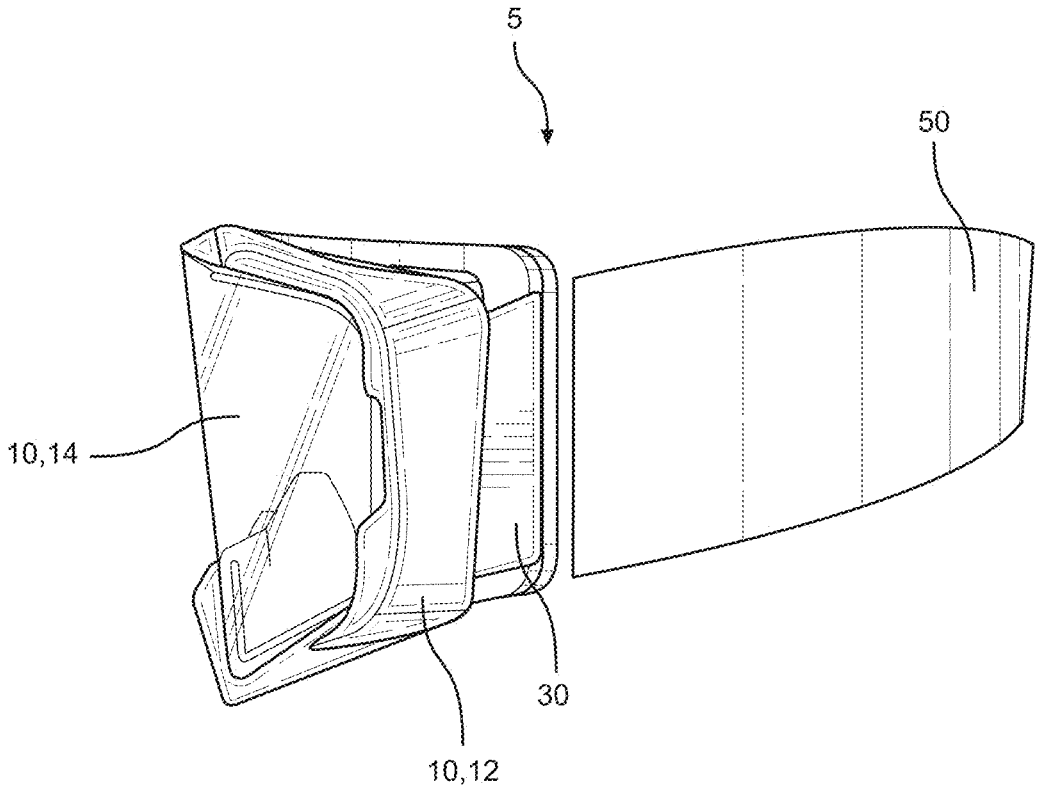
FIG. 5 is a left side elevation view of goggles that are reversibly magnetically attachable to a helmet.

| Term | Definition |
|---|---|
| 5 | Goggles that are Reversibly Magnetically Attachable to a Helmet |
| 10 | Goggle |
| 12 | Goggle Frame |
| 14 | Goggle Lens |
| 15 | Upper Horizontal Member |
| 16 | Left Vertical Member |
| 17 | Right Vertical Member |
| 18 | Lower Horizontal Member |
| 20 | Right Magnet |
| 30 | Left Magnet |
| 40 | Right Temple Plate |
| 42 | Rigid Planar Ferromagnetic Member on Right Temple Plate |
| 44 | Arced, Curved, Or Partial Spherically Shaped Ferromagnetic Member on Right Temple Plate |
| 50 | Left Temple Plate |
| 52 | Rigid Planar Ferromagnetic Member on Right Temple Plate |
| 54 | Arced, Curved, Or Partial Spherically Shaped Ferromagnetic Member on Left Temple Plate |
| 60 | Helmet |
| 100 | Person, User, or Purchaser |

DETAILED DESCRIPTION OF THE INVENTION

Goggles that are reversibly magnetically attachable to a helmet 5 comprise: a goggle 10; a right magnet 20; a left magnet 30; a right temple plate 40; and a left temple plate 50. Goggles that are reversibly magnetically attachable to a helmet 5 are described as a goggle assembly in the claims.

Goggle 10 is a pair of safety glasses or protective eyewear that encloses or protects the area surrounding of the eyes in order to prevent particulates, water, mist, air, or chemicals from striking the eyes. A complete perimeter seal is formed on the skin around the eyes to prevent air and particulate leaks therethrough. There is one complete perimeter seal that encompasses both eyes of the user.

As discussed below, in order to use this invention, the right temple plate 40 and the left temple plate 50 are both rigidly attached to a helmet 60. A helmet 60 is a hard or padded protective hat or headwear that is worn by the user to protect their head and face. Helmets 60 are typically worn by soldiers, police officers, firefighters, motorcyclists, athletes, and many others. With this invention, the user can simply magnetically snap or click his goggles on and off without the need for any goggle straps. The right temple plate 40 provides a metallic surface for the right magnet 20 on the goggle 10 to stick to or attach to. The left temple plate 50 provides a metallic surface for the left magnet 30 on the goggle 10 to stick to or attach to.

Goggle 10 comprises: a frame 12; a lens 14; a right magnet 20; and a left magnet 30. Frame 12 is a semi-rigid arced, curved, or partial spherically shaped support frame with a hollow center. Frame 12 has an upper horizontal member 15, a left vertical member 16, a right vertical member 17, and a lower horizontal member 18. The upper horizontal member 15 is obviously the upper horizontal member of the frame 12, above the lens 14. The left vertical member 16 is obviously the left vertical member of the frame 12 on the left side of the lens 14. The right vertical member 17 is obviously the right vertical member on the frame 12 on the right side of the lens 14. The lower horizontal member 18 is obviously the lower horizontal member of the frame 12, below the lens 14. Lower horizontal member 18 is the part of the frame 12 that rests on the user's nose. The upper horizontal member 15 has a left end, a right end, an upper edge, a lower edge, an inside surface, an outside surface, a length, and a longitudinal axis. The left vertical member 16 has an upper end, a lower end, an outer edge, an inner edge, an inner surface, an outer surface, a length, and a longitudinal axis. The right vertical member 17 has an upper end, a lower end, an outer edge, an inner edge, an inner surface, an outer surface, a length, and a longitudinal axis. The lower horizontal member 18 has a left end, a right end, an upper edge, a lower edge, an inside surface, an outside surface, a length, and a longitudinal axis.

Throughout this writing, left is designated as the side that is adjacent to the left side of the person wearing the goggles that are reversibly magnetically attachable to a helmet 5, right is designated as the side that is adjacent to the right side of the person wearing the goggles that are reversibly magnetically attachable to a helmet 5, upper is designated as the side that is adjacent to the top of the person's head, lower is designated as the side that is adjacent to the bottom of the person head, inner is designated as the side that is adjacent the person wearing the goggles that are reversibly magnetically attachable to a helmet 5, and outer is designated as the side that is opposite to the person wearing the goggles that are reversibly magnetically attachable to a helmet 5.

The upper horizontal member 15, left vertical member 16, right vertical member 17, and lower horizontal member 18 are connected together to form the semi-rigid arced, curved, or partial spherically support frame with a hollow center. The left end of the upper horizontal member 15 is rigidly attached to the upper end of the left vertical member 16. The right end of the upper horizontal member 15 is rigidly attached to the upper end of right vertical member 17. The lower end of the right vertical member 17 is rigidly attached to the right end of the lower horizontal member 18. The left end of the lower horizontal member 18 is rigidly attached to the lower end of the left vertical member 16. The inner surfaces of horizontal member, left vertical member 16, right vertical member 17, and lower horizontal member 18 align to form an overall inner surface of the frame 12. The outer surfaces of horizontal member, left vertical member 16, right vertical member 17, and lower horizontal member 18 align to form an overall outer surface of the frame 12. The inner edges of upper horizontal member 15, left vertical member 16, right vertical member 17, and lower horizontal member 18 form a contour that matches that of lens 14. In best mode, upper horizontal member 15, left vertical member 16, right vertical member 17, and lower horizontal member 18 are integral and made of the same piece of material.

The overall outer surface of frame 12 is a convex surface that is shaped and contoured to match the shape of a person's face around their eyes where the frame 12 contacts the forehead, the outer sides of each eye, and the lower portion of the eyes including the bridge of the nose. The overall inner surface of frame 12 is a concave surface that is shaped and contoured to be the exact inverse shape of a person's face around their eyes where so that frame 12 contacts the forehead, the outer sides of each eye, and the lower portion of the eyes including the bridge of the nose. The lower horizontal member 18 further comprise an inverted U-shaped bend that is the exact inverse shape the bridge of a person's nose. The overall inner surface of frame 12 must make an airtight connection and seal with the person's face in order to prevent air and particles from passing therethrough. Frame 12 functions to create an airtight seal to a person's face and to hold the lens 14. The inner surfaces of horizontal member, left vertical member 16, right vertical member 17, and lower horizontal member 18 may have a gasket material or foam material attached thereto in order to help create this seal to the person's face. Frame 12 also functions to hold and retain: goggle lens 14; right magnet 20; and left magnet 30.

Lens 14 is a semi-rigid arced, curved, or partial spherically shaped transparent or clear member. Lens 14 is transparent or clear to allow a person to clearly see through the lens14. The arc or curvature on lens 14 matches that of frame 12. Lens 14 has a perimeter contour that matches the inner edges of upper horizontal member 15, left vertical member 16, right vertical member 17, and lower horizontal member 18. The perimeter of lens 14 is attached to the inner edges of upper horizontal member 15, left vertical member 16, right vertical member 17, and lower horizontal member 18 to make an airtight connection therewith. Lens 14 functions to keep air and particles out of the person's eyes. Lens 14 is a typical lens of a standard goggle.

Right magnet 20 is a magnet or a piece of ferromagnetic material that produces a magnetic field. A magnetic field is invisible field or force that pulls on other ferromagnetic materials. A ferromagnetic material is material that can be magnetized, such as, iron, steel, nickel, cobalt, lodestone, or similar materials. Ferromagnetic material attracts or repels other magnets. Right magnet 20 is a permanent magnet that is an object made from a material that is permanently magnetized and creates its own persistent magnetic field. Although, ferromagnetic materials are the only materials that are attracted to a magnet strongly enough to be commonly considered magnetic, all other substances respond weakly to a magnetic field. Right magnet 20 has a left edge, a right edge, an upper edge, a lower edge, an inner surface, an outer surface, an overall thickness, an overall height, an overall width, a longitudinal axis, a latitudinal axis, a vertical profile, and a horizontal profile. Right magnet 20 is specially shaped to align with the shape right vertical member 17 of frame 12 and the shape of right temple plate 40. The outer surface of right magnet 20 is specially shaped to align with the inner surface of right vertical member 17. The inner surface of right magnet 20 and the vertical profile of right magnet 20 are specially shaped to align with the shape of right temple plate 40 and the location of right temple plate 40 after being properly attached to the helmet 60 as discussed below. The height of right magnet 20 is equal to or slightly less than the length of right vertical member 17. The width of right magnet 20 is about 0.2-2 inches. The thickness of right magnet 20 is about 0.1-1 inches. The outside surface of right magnet 20 is rigidly attached to the inner surface of right vertical member 17 so that the upper edge of right magnet 20 is adjacent to the upper end of right vertical member 17, the lower edge of right magnet 20 is adjacent to the lower end of right vertical member 17, the inner edge of right magnet 20 is adjacent to the inner edge of right vertical member 17, and the outer edge of right magnet 20 is adjacent to the outer edge of right vertical member 17. Rigid attachment may be accomplished by any known means such as: weld, solder, glue, epoxy, adhesive, bolts, screws, rivets, clips, snaps, pins, or fasteners.

Figure 6:
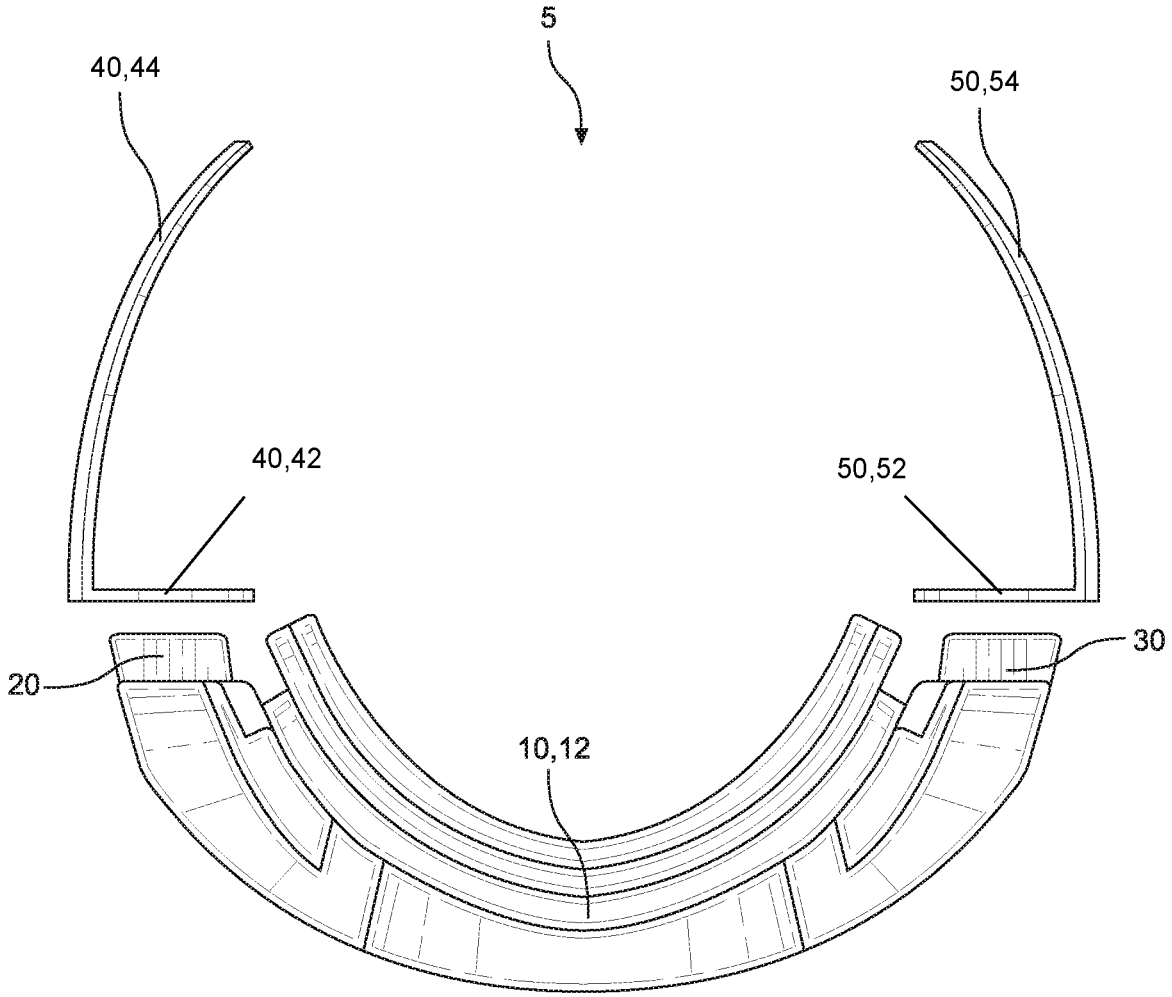
FIG. 6 is a top plan view of goggles that are reversibly magnetically attachable to a helmet.
Figure 7:
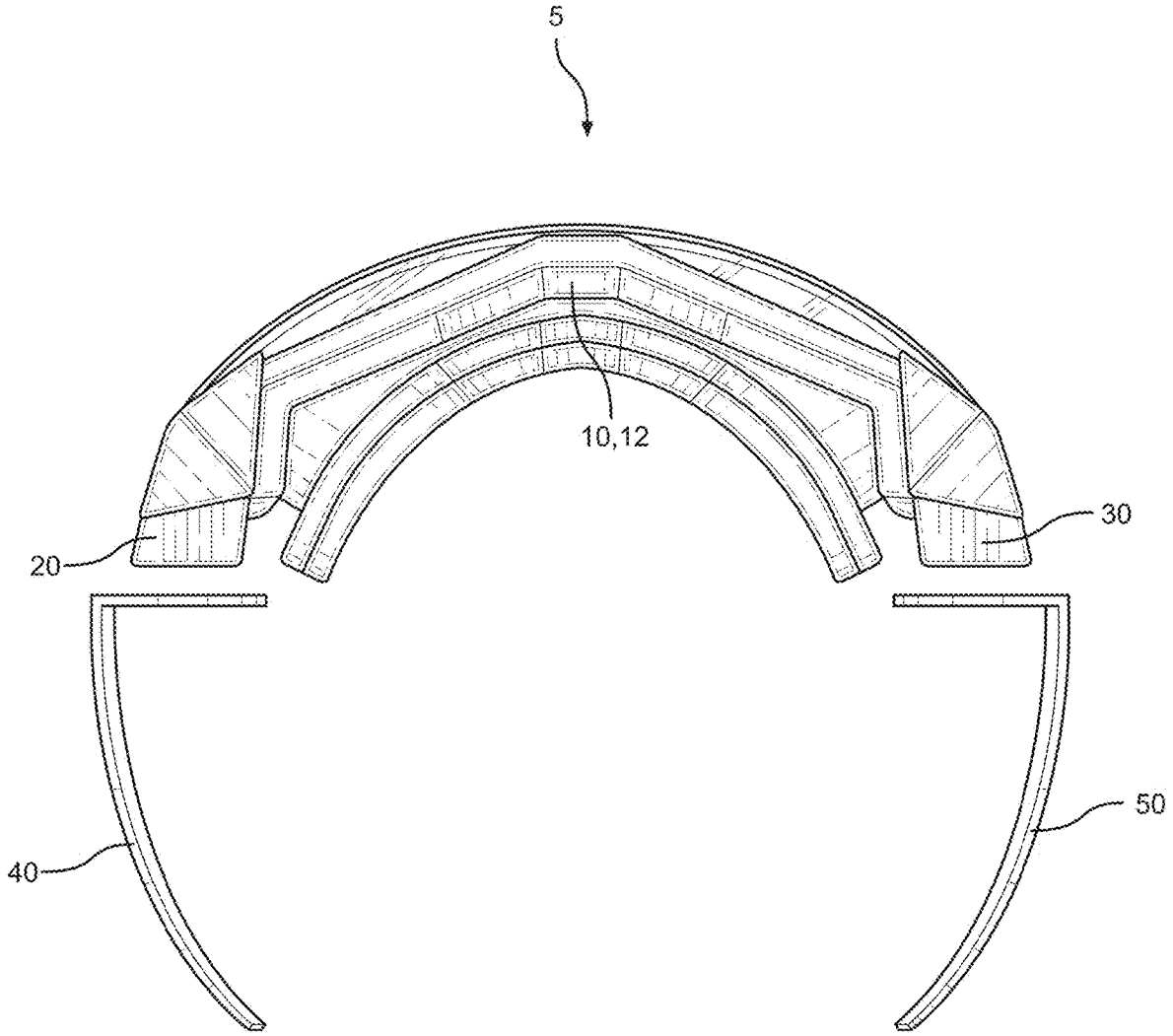
FIG. 7 is a bottom plan view of goggles that are reversibly magnetically attachable to a helmet.
Figure 8:
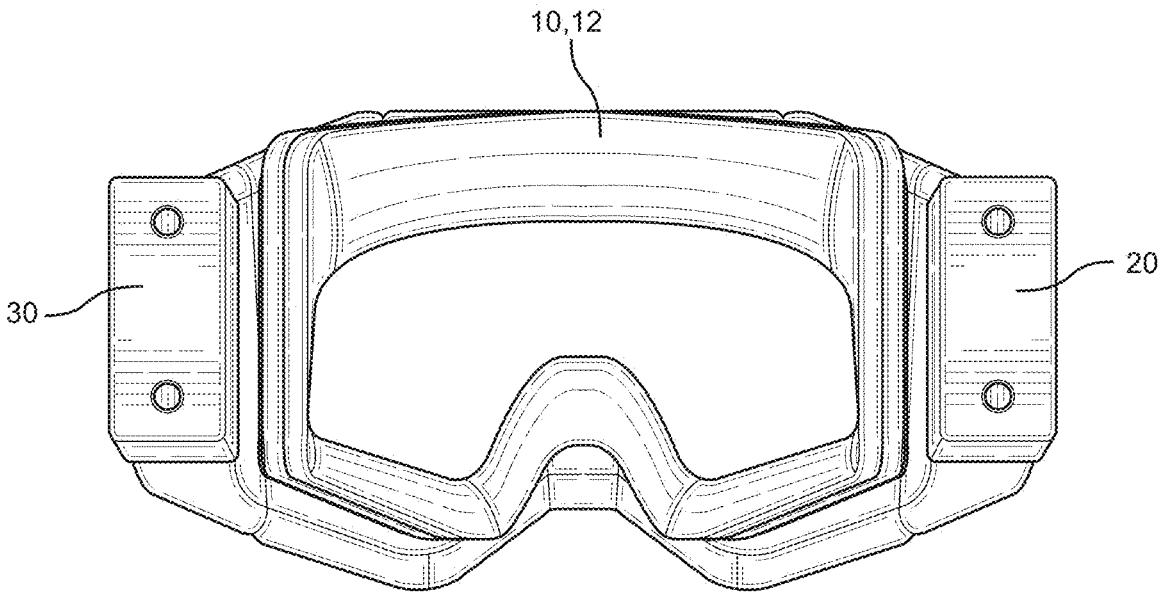
FIG. 8 is a rear elevation view of goggles that are reversibly magnetically attachable to a helmet without the right and left temple plates.
Figure 9:
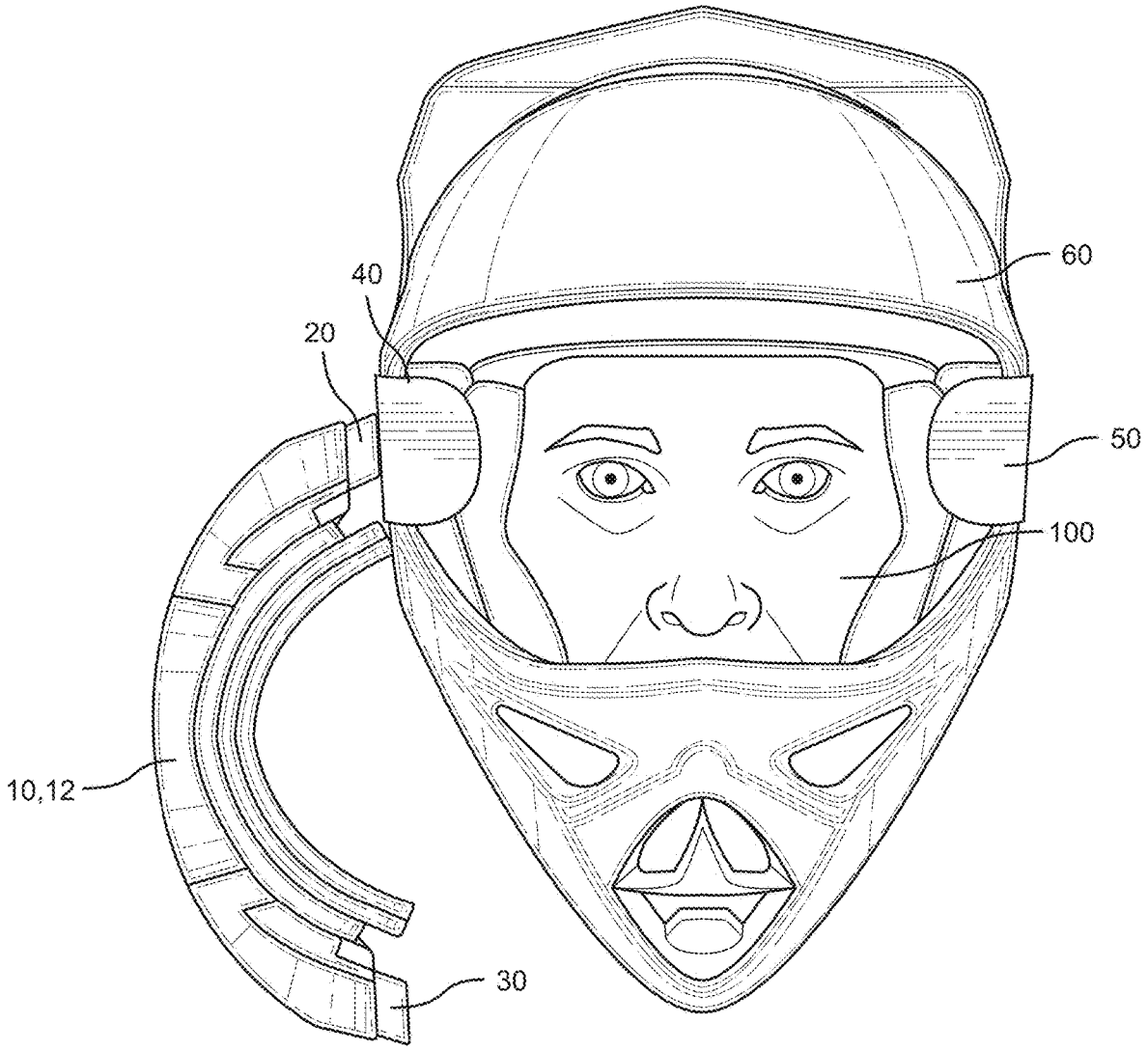
FIG. 9 is view of the invention installed onto or attached to a helmet that is on a person, depicting the goggles magnetically attached to the side of the right temple plate in a storage position.
Figure 10:
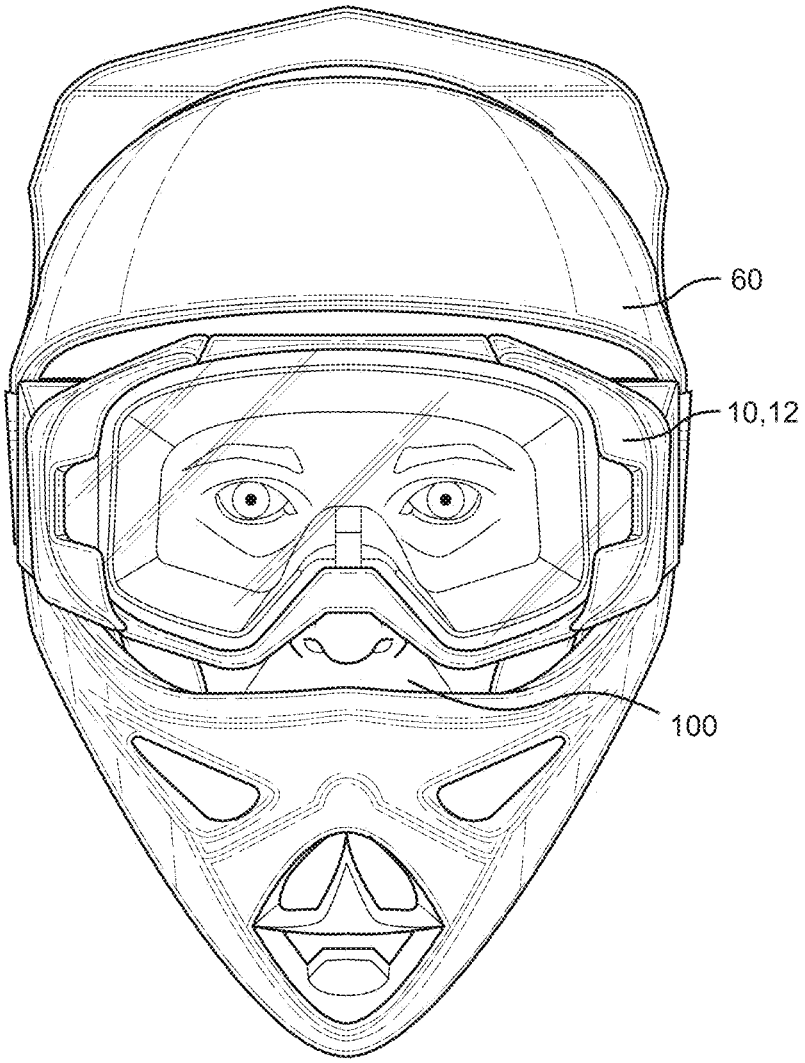
FIG. 10 is view of the invention installed onto or attached to a helmet that is on a person, depicting the goggles magnetically attached to the right and left temple plates in the ready position on the person's face and protecting the eyes.
Figure 11:
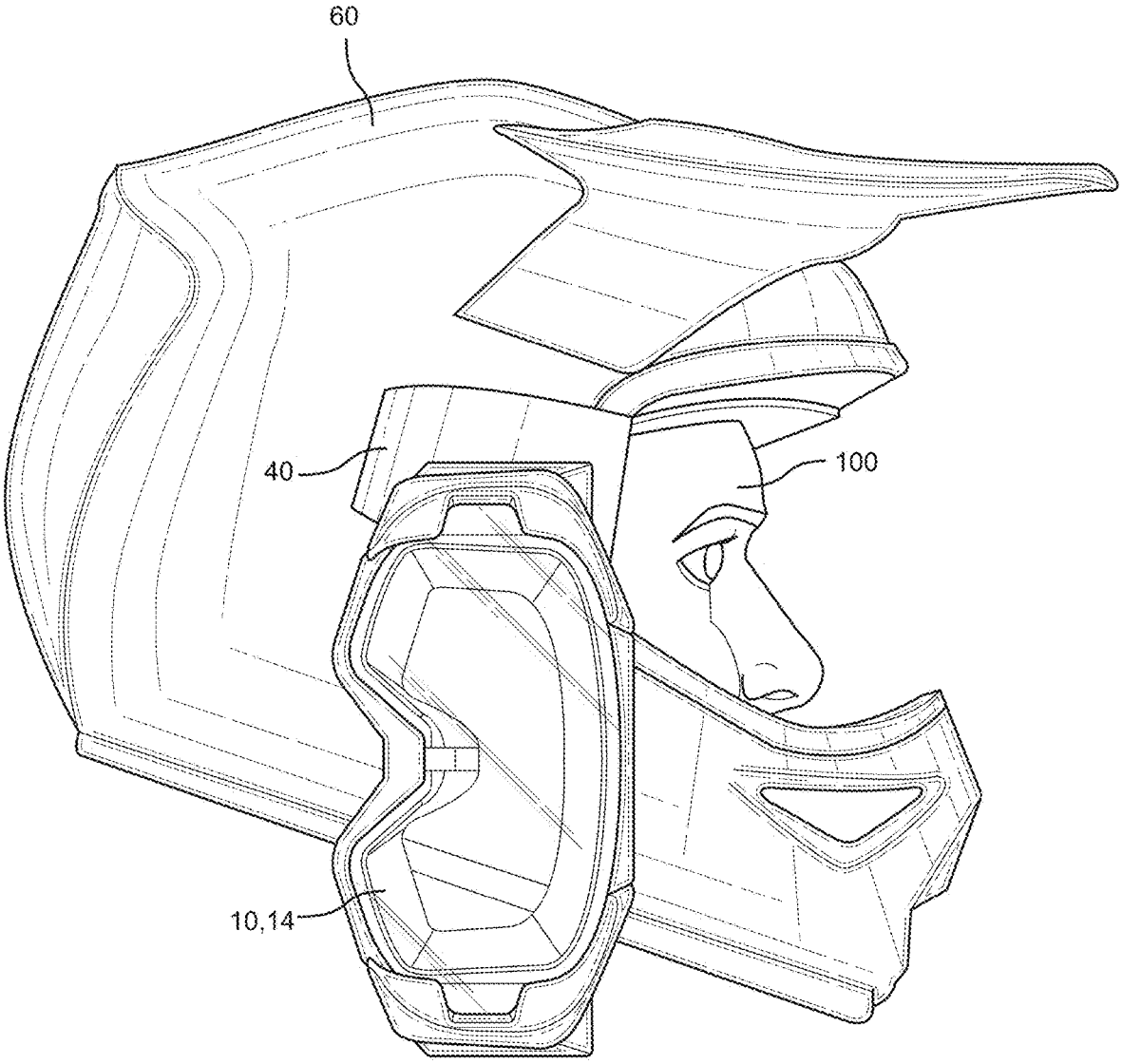
FIG. 11 is a right side elevation view of FIG. 9.
Figure 12:
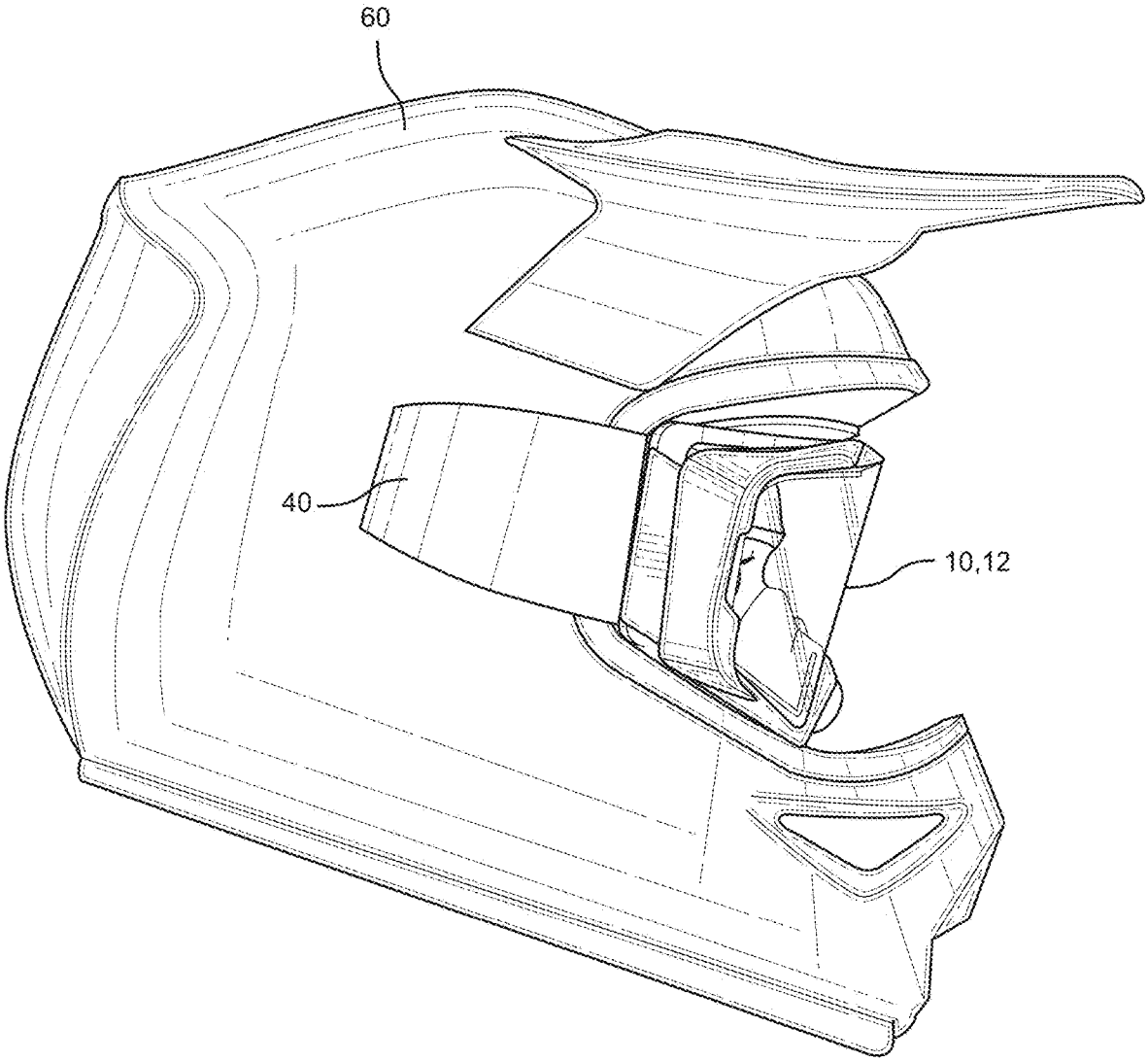
FIG. 12 is a right side elevation view of FIG. 10.

Right magnet 20 may be a cube, a rectangular cuboid, or a parallelepiped. In best mode, right magnet 20 is essentially a parallelepiped wherein the vertical profile is a parallelogram as depicted in FIG. 6. With this shape, the inner surface of right magnet 20 is projected farther to the right as compared to the outer surface of right magnet 20. This projection or shape of right magnet 20 may be required in order for the right magnet 20 to properly reversibly magnetically attach to the right temple plate 40 wherein the location of the right temple plate 40 is predetermined by proper attachment to the helmet 60 as discussed below. With the parallelepiped shape of right magnet 20, the angle between the left edge and the inner surface is an obtuse angle and the angle between the outer edge and the inner surface is an acute angle.

Left magnet 30 is a magnet or a piece of ferromagnetic material that produces a magnetic field. Left magnet 30 is a permanent magnet that is an object made from a material that is permanently magnetized and creates its own persistent magnetic field. Left magnet 30 has a left edge, a right edge, an upper edge, a lower edge, an inner surface, an outer surface, an overall thickness, an overall height, an overall width, a longitudinal axis, a latitudinal axis, a vertical profile, and a horizontal profile. Left magnet 30 is specially shaped to align with the shape left vertical member 16 of frame 12 and the shape of left temple plate 50. The outer surface of left magnet 30 is specially shaped to align with the inner surface of left vertical member 16. The inner surface of left magnet 30 and the vertical profile of left magnet 30 are specially shaped to align with the shape of left temple plate 50 and the location of left temple plate 50 after being properly attached to the helmet 60 as discussed below. The height of left magnet 30 is equal to or slightly less than the length of left vertical member 16. The width of left magnet 30 is about 0.2-2 inches. The thickness of left magnet 30 is about 0.1-1 inches. The outside surface of left magnet 30 is rigidly attached to the inner surface of left vertical member 16 so that the upper edge of left magnet 30 is adjacent to the upper end of left vertical member 16, the lower edge of left magnet 30 is adjacent to the lower end of left vertical member 16, the inner edge of left magnet 30 is adjacent to the inner edge of left vertical member 16, and the outer edge of left magnet 30 is adjacent to the outer edge of left vertical member 16. Rigid attachment may be accomplished by any known means such as: weld, solder, glue, epoxy, adhesive, bolts, screws, rivets, clips, snaps, pins, or fasteners.

Left magnet 30 may be a cube, a rectangular cuboid, or a parallelepiped. In best mode, left magnet 30 is essentially a parallelepiped wherein the vertical profile is a parallelogram as depicted in FIG. 6. With this shape, the inner surface of left magnet 30 is projected farther to the left as compared to the outer surface of left magnet 30. This projection or shape of left magnet 30 may be required in order for the left magnet 30 to properly reversibly magnetically attach to the left temple plate 50 wherein the location of the left temple plate 50 is predetermined by proper attachment to the helmet 60 as discussed below. With the parallelepiped shape of left magnet 30, the angle between the left edge and the inner surface is an acute angle and the angle between the outer edge and the inner surface is an obtuse angle.

Right temple plate 40 is a rigid planar ferromagnetic member 42 attached to an arced, curved, or partial spherically shaped ferromagnetic member.

Rigid planar ferromagnetic member 42 on right temple plate 40 is a rigid planar member with a left edge, a right edge, an upper edge, a lower edge, an inner surface, an outer surface, a plane, a height, and a width. Rigid planar ferromagnetic member 42 on right temple plate 40 is made of a ferromagnetic material. Rigid planar ferromagnetic member 42 may be a permanent magnet or just a piece of metal with iron in it such as iron, nickel, steel, or cobalt. All metal with a significant portion of iron in it is attracted to a magnet. The height of rigid planar ferromagnetic member 42 on right temple plate 40 is sized to be slightly smaller than the vertical gap on the right side of the front opening of the helmet 60 so that the rigid planar ferromagnetic member 42 on right temple plate 40 may fit therein as depicted. In best mode, the lower edge, inner edge, and upper edge are rounded so that there is no hard corner between the lower edge and the inner edge and no hard corner between the upper edge and the inner edge.

Arced, curved, or partial spherically shaped ferromagnetic member 44 on right temple plate 40 is a two dimensional rigid arced, curved, or partial spherically shaped member with an inner surface, an outer surface, a front edge, a rear tail, an upper edge, a lower edge, and an inner radius. Arced, curved, or partial spherically shaped ferromagnetic member 44 on right temple plate 40 is made of a ferromagnetic material. Arced, curved, or partial spherically shaped ferromagnetic member 44 may be a permanent magnet or just a piece of metal with iron in it such as iron, nickel, steel, or cobalt. All metal with iron in it is attracted to a magnet. The inner radius of arced, curved, or partial spherically shaped ferromagnetic member 44 on right temple plate 40 is defined as the radius of spherical curvature of the inner surface of arced, curved, or partial spherically shaped ferromagnetic member 44. The inner radius of arced, curved, or partial spherically shaped ferromagnetic member 44 matches the radius of spherical curvature of the outer surface of the helmet 60 at the attachment location on the right side of the helmet 60. The radius of spherical curvature of the outer surface of the helmet 60 at the attachment location on the right side of the helmet 60 is typically slightly different for each brand and model of helmet 60. Thus, different modes may be required for each different each brand and model of helmet 60. The radius of spherical curvature of the outer surface of the helmet 60 at the attachment location on the right side of the helmet 60 is approximately 4-10 inches. Additionally, the spherical curvature of the outer surface of the helmet 60 at the attachment location on the right side of the helmet 60 may not be exactly spherical but may have different bumps and/or depressions in the spherical shape. In these cases, arced, curved, or partial spherically shaped ferromagnetic member 44 on right temple plate 40 would be custom molded or custom shaped to exactly match the spherical shape with different bumps and/or depressions on particular brand and model of the helmet 60.

The length of the outer edge of rigid planar ferromagnetic member 42 is equal to the length of front edge of arced, curved, or partial spherically shaped ferromagnetic member 44 so that the edges of these members align and match up. The right edge of rigid planar ferromagnetic member 42 is rigidly attached to the front edge of arced, curved, or partial spherically shaped ferromagnetic member 44 so that the plane of rigid planar ferromagnetic member 42 is essentially perpendicular to the radius of arced, curved, or partial spherically shaped ferromagnetic member 44 at the seam of attachment. The inner surface of arced, curved, or partial spherically shaped ferromagnetic member 44 is rigidly attached to the exterior surface of the helmet 60 at the proper location as depicted. Rigid attachment may be accomplished by any known means such as: weld, solder, glue, epoxy, adhesive, bolts, screws, rivets, clips, snaps, pins, or fasteners. In best mode, the inner surface of arced, curved, or partial spherically shaped ferromagnetic member 44 has an adhesive coating and a release liner which function to rigidly attach the right temple plate 40 to the helmet 60 at the proper location as depicted. Adhesive coating could be: glue, double sided tape, fixative, cement, bonding agent, epoxy, welding agent, or other similar material that strongly bonds to the particular surface and material of the exterior surface of a helmet 60. The adhesive coating is attached to the inner surface of arced, curved, or partial spherically shaped ferromagnetic member 44 of right temple plate 40. Next a release liner film is attached to the adhesive coating. The release liner is a layer of flexible material with a non-stick or non-adherent coating to prevent the adhesive coating from sticking to something unintended. The adhesive coating and a release liner function to rigidly attach the right temple plate 40 to the helmet 60.

Left temple plate 50 is a rigid planar ferromagnetic member 52 attached to an arced, curved, or partial spherically shaped ferromagnetic member 54.

Rigid planar ferromagnetic member 52 on left temple plate 50 is a rigid planar member with a left edge, a right edge, an upper edge, a lower edge, an inner surface, an outer surface, a plane, a height, and a width. Rigid planar ferromagnetic member 52 on left temple plate 50 is made of a ferromagnetic material. Rigid planar ferromagnetic member 52 may be a permanent magnet or just a piece of metal with iron in it such as iron, nickel, steel, or cobalt. The height of rigid planar ferromagnetic member 52 on left temple plate 50 is sized to be slightly smaller than the vertical gap on the left side of the front opening of the helmet 60 so that the rigid planar ferromagnetic member 52 may fit therein as depicted. In best mode, the lower edge, inner edge, and upper edge are rounded so that there is no hard corner between the lower edge and the inner edge and no hard corner between the upper edge and the inner edge.

Arced, curved, or partial spherically shaped ferromagnetic member 54 on left temple plate 50 is a two dimensional rigid arced, curved, or partial spherically shaped member with an inner surface, an outer surface, a front edge, a rear tail, an upper edge, a lower edge, and an inner radius. Arced, curved, or partial spherically shaped ferromagnetic member 54 on left temple plate 50 is made of a ferromagnetic material. Arced, curved, or partial spherically shaped ferromagnetic member 54 may be a permanent magnet or just a piece of metal with iron in it such as iron, nickel, steel, or cobalt. The inner radius of arced, curved, or partial spherically shaped ferromagnetic member 54 on left temple plate 50 is defined as the radius of spherical curvature of the inner surface of arced, curved, or partial spherically shaped ferromagnetic member 54. The inner radius of arced, curved, or partial spherically shaped ferromagnetic member 54 matches the radius of spherical curvature of the outer surface of the helmet 60 at the attachment location on the right side of the helmet 60. The radius of spherical curvature of the outer surface of the helmet 60 at the attachment location on the left side of the helmet 60 is typically slightly different for each brand and model of helmet 60. Thus, different modes may be required for each different each brand and model of helmet 60. The radius of spherical curvature of the outer surface of the helmet 60 at the attachment location on the left side of the helmet 60 is approximately 4-10 inches. Additionally, the spherical curvature of the outer surface of the helmet 60 at the attachment location on the left side of the helmet 60 may not be exactly spherical but may have different bumps and/or depressions in the spherical shape. In these cases, arced, curved, or partial spherically shaped ferromagnetic member 54 on right temple plate 40 would be custom molded or custom shaped to exactly match the spherical shape with different bumps and/or depressions on particular brand and model of the helmet 60.

The length of the outer edge of rigid planar ferromagnetic member 52 is equal to the length of front edge of arced, curved, or partial spherically shaped ferromagnetic member 54 so that the edges of these members align and match up. The right edge of rigid planar ferromagnetic member 52 is rigidly attached to the front edge of arced, curved, or partial spherically shaped ferromagnetic member 54 so that the plane of rigid planar ferromagnetic member 52 is essentially perpendicular to the radius of arced, curved, or partial spherically shaped ferromagnetic member 54 at the seam of attachment. The inner surface of arced, curved, or partial spherically shaped ferromagnetic member 54 is rigidly attached to the exterior surface of the helmet 60 at the proper location as depicted. Rigid attachment may be accomplished by any known means such as: weld, solder, glue, epoxy, adhesive, bolts, screws, rivets, clips, snaps, pins, or fasteners. In best mode, the inner surface of arced, curved, or partial spherically shaped ferromagnetic member 54 has an adhesive coating and a release liner which function to rigidly attach the left temple plate 50 to the helmet 60 at the proper location as depicted. Adhesive coating could be: glue, double sided tape, fixative, cement, bonding agent, epoxy, welding agent, or other similar material that strongly bonds to the particular surface and material of the exterior surface of a helmet 60. The adhesive coating is attached to the inner surface of arced, curved, or partial spherically shaped ferromagnetic member 54 of left temple plate 50. Next a release liner film is attached to the adhesive coating. The release liner is a layer of flexible material with a non-stick or non-adherent coating to prevent the adhesive coating from sticking to something unintended. The adhesive coating and a release liner function to rigidly attach the left temple plate 50 to the helmet 60.

In one embodiment, goggles that are reversibly magnetically attachable to a helmet 5 are sold as a three-piece set that comprises: 1) the special goggle 10 with left and right magnets 40,50 along with 2) the right temple plate 40 and 3) the left temple plate 50. This would be the least expensive way to practice the invention. With this embodiment, the purchaser, user, or person 100 must rigidly attach the right temple plate 40 and the left temple plate 50 to the exterior of the helmet 60 his or herself in order to practice the invention. To do this, the purchaser, user, or person 100 should clean and dry the exterior surface of the helmet 60 at the attachment locations for the right temple plate 40 and the left temple plate 50. Then remove the release liner on the right temple plate 40. Then place the inner surface of the rigid planar ferromagnetic member 42 of the right temple plate 40 in contact with the vertical member on the right side of the front opening of the helmet 60 and hold contact therewith as the adhesive coating on the inner surface of the arced, curved, or partial spherically shaped ferromagnetic member 44 on right temple plate 40 is pressed onto the exterior surface of the helmet 60 to rigidly attach on right temple plate 40 is pressed onto the exterior surface of the helmet 60. Thus, inner surface of the rigid planar ferromagnetic member 42 of the right temple plate 40 should remained pressed against vertical member on the right side of the front opening of the helmet 60 to ensure proper attachment of the right temple plate 40 to the helmet 60. This placement of right temple plate 40 helps ensure that the goggle 10 with left and right magnets 40,50 can be attached to and removed from the helmet 60 properly. Then remove the release liner on the left temple plate 50. Then place the inner surface of the rigid planar ferromagnetic member 52 of the left temple plate 50 in contact with the vertical member on the left side of the front opening of the helmet 60 and hold contact therewith as the adhesive coating on the inner surface of the arced, curved, or partial spherically shaped ferromagnetic member 54 on left temple plate 50 is pressed onto the exterior surface of the helmet 60 to rigidly attach on left temple plate 50 is pressed onto the exterior surface of the helmet 60. Thus, inner surface of the rigid planar ferromagnetic member 52 of the left temple plate 50 should remained pressed against vertical member on the right side of the front opening of the helmet 60 to ensure proper attachment of the left temple plate 50 to the helmet 60. This placement of left temple plate 50 helps ensure that the goggle 10 with left and right magnets 40,50 can be attached to and removed from the helmet 60 properly.

In another embodiment, goggles that are reversibly magnetically attachable to a helmet 5 are sold while already included into a helmet 60. With this embodiment, goggles that are reversibly magnetically attachable to a helmet 5 comprise: a goggle 10; a right magnet 20; a left magnet 30; a right temple plate 40; a left temple plate 50; and a helmet 60. In this embodiment, everything is the same as detailed above, with the exceptions that the right temple plate 40 and left temple plate 50 do not include an adhesive coating and release liner. The right temple plate 40 and left temple plate 50 are pre-attached to the helmet 60 at the helmet factory or by the helmet supplier. In best mode, the right temple plate 40 and left temple plate 50 are both molded directly into to the exterior surface or interior surface of the helmet 60 at the proper locations and orientations as the helmet is initially being formed, casted, or molded. Alternately, the right temple plate 40 and left temple plate 50 can simply be rigidly attached to the exterior surface of the helmet 60 at the proper locations and orientations after the helmet has been formed, casted, or molded, at the helmet factory or by the helmet supplier, wherein rigid attachment is accomplished by any known means such as: weld, solder, glue, epoxy, adhesive, bolts, screws, rivets, clips, snaps, pins, or fasteners. Of course, with this embodiment, the helmet factory or the helmet supplier would include the goggle 10 comprising: the frame 12; a lens 14; a right magnet 20; and a left magnet 30 with the special helmet 60 with attached right and left temple plates 40,50. Thus, in this embodiment, the helmet 60 is sold with attached goggle 10; right magnet 20; left magnet 30; right temple plate 40; and left temple plate 50.

In all embodiments, goggles 10 are attached to the helmet 60 and placed in the ready position to protect the eyes of the purchaser, user, or person 100 by simply aligning the inner surface of the right magnet 20 with the outer surface of the right temple plate 40 and aligning the inner surface of the left magnet 30 with the outer surface of the left temple plate 50, which causes the goggles 10 to magnetically attach in place and to click into place. The goggles 10 can be adjusted slightly left, right, up, and down in order to position the goggles 10 exactly at the correct spot in order to center the goggles 10 on the eyes and nose of the purchaser, user, or person 100. To remove the goggles 10, the purchaser, user, or person 100 merely pulls the goggles outward to disengage the magnetic attachment and remove the goggles 10.

What is claimed:

1. A goggle assembly comprising: a goggle; a right magnet; a left magnet; a right temple plate; and a left temple plate, wherein, said goggle comprises: a frame and a lens, wherein, said frame is a semi-rigid arced, curved, or partial spherically shaped support frame with a hollow center, said frame has an upper horizontal member, a left vertical member, a right vertical member, and a lower horizontal member, said upper horizontal member has a left end, a right end, an upper edge, a lower edge, an inside surface, an outside surface, a length, and a longitudinal axis, said left vertical member has an upper end, a lower end, an outer edge, an inner edge, an inner surface, an outer surface, a length, and a longitudinal axis, said right vertical member has an upper end, a lower end, an outer edge, an inner edge, an inner surface, an outer surface, a length, and a longitudinal axis, said lower horizontal member has a left end, a right end, an upper edge, a lower edge, an inside surface, an outside surface, a length, and a longitudinal axis, said lens is a semi-rigid arced, curved, or partial spherically shaped transparent or clear member with a perimeter, and said perimeter of said lens is attached to: said inner edge of said upper horizontal member, said inner edge of said left vertical member, said inner edge of said right vertical member, and said inner edge of said lower horizontal member to make an airtight connection therewith, said right magnet is a magnet or a piece of ferromagnetic material that produces a magnetic field, said right magnet has a left edge, a right edge, an upper edge, a lower edge, an inner surface, an outer surface, an overall thickness, an overall height, an overall width, a longitudinal axis, a latitudinal axis, a vertical profile, and a horizontal profile, said outer surface of said right magnet is rigidly attached to said inner surface of said right vertical member of said frame, said left magnet is a magnet or a piece of ferromagnetic material that produces a magnetic field, said left magnet has a left edge, a right edge, an upper edge, a lower edge, an inner surface, an outer surface, an overall thickness, an overall height, an overall width, a longitudinal axis, a latitudinal axis, a vertical profile, and a horizontal profile, said outside surface of said left magnet is rigidly attached to said inner surface of said left vertical member of said frame, said right temple plate is a rigid planar ferromagnetic member attached to an arced, curved, or partial spherically shaped ferromagnetic member, wherein, said rigid planar ferromagnetic member of said right temple plate is a rigid planar member with a left edge, a right edge, an upper edge, a lower edge, an inner surface, an outer surface, a plane, a height, and a width, said rigid planar ferromagnetic member of said right temple plate is made of a ferromagnetic material, said arced, curved, or partial spherically shaped ferromagnetic member of said right temple plate is a two dimensional rigid arced, curved, or partial spherically shaped member with an inner surface, an outer surface, a front edge, a rear tail, an upper edge, a lower edge, and an inner radius, said arced, curved, or partial spherically shaped ferromagnetic member of said right temple plate is made of a ferromagnetic material, said length of said outer edge of said rigid planar ferromagnetic member of said right temple plate is equal to said length of said front edge of said arced, curved, or partial spherically shaped ferromagnetic member of said right temple plate, said right edge of said rigid planar ferromagnetic member of said right temple plate is rigidly attached to said front edge of said arced, curved, or partial spherically shaped ferromagnetic member of said right temple plate so that said plane of rigid planar ferromagnetic member of said right temple plate is perpendicular to said inner radius of arced, curved, or partial spherically shaped ferromagnetic member of said right temple plate, and said inner surface of said arced, curved, or partial spherically shaped ferromagnetic member of said right temple plate has an adhesive coating and a release liner thereon, and said left temple plate is a rigid planar ferromagnetic member attached to an arced, curved, or partial spherically shaped ferromagnetic member, wherein, said rigid planar ferromagnetic member of said left temple plate is a rigid planar member with a left edge, a right edge, an upper edge, a lower edge, an inner surface, an outer surface, a plane, a height, and a width, said rigid planar ferromagnetic member of left temple plate is made of a ferromagnetic material, said arced, curved, or partial spherically shaped ferromagnetic member of left temple plate is a two dimensional rigid arced, curved, or partial spherically shaped member with an inner surface, an outer surface, a front edge, a rear tail, an upper edge, a lower edge, and an inner radius, said arced, curved, or partial spherically shaped ferromagnetic member of said left temple plate is made of a ferromagnetic material, said length of said outer edge of rigid planar ferromagnetic member of said left temple plate is equal to said length of said front edge of said arced, curved, or partial spherically shaped ferromagnetic member of said left temple plate, said right edge of said rigid planar ferromagnetic member of said left temple plate is rigidly attached to said front edge of said arced, curved, or partial spherically shaped ferromagnetic member so that said plane of said rigid planar ferromagnetic member of said left temple plate is perpendicular to said inner radius of said arced, curved, or partial spherically shaped ferromagnetic member of said left temple plate, and said inner surface of said arced, curved, or partial spherically shaped ferromagnetic member of said left temple plate has an adhesive coating and a release liner thereon.

2. A goggle assembly comprising: a goggle; a right magnet; a left magnet; a right temple plate; a left temple plate, and a helmet, wherein, said goggle comprises: a frame; a lens, wherein, said frame is a semi-rigid arced, curved, or partial spherically shaped support frame with a hollow center, said frame has an upper horizontal member, a left vertical member, a right vertical member, and a lower horizontal member, said upper horizontal member has a left end, a right end, an upper edge, a lower edge, an inside surface, an outside surface, a length, and a longitudinal axis, said left vertical member has an upper end, a lower end, an outer edge, an inner edge, an inner surface, an outer surface, a length, and a longitudinal axis, said right vertical member has an upper end, a lower end, an outer edge, an inner edge, an inner surface, an outer surface, a length, and a longitudinal axis, said lower horizontal member has a left end, a right end, an upper edge, a lower edge, an inside surface, an outside surface, a length, and a longitudinal axis, said lens is a semi-rigid arced, curved, or partial spherically shaped transparent or clear member with a perimeter, and said perimeter of said lens is attached to: said inner edge of said upper horizontal member, said inner edge of said left vertical member, said inner edge of said right vertical member, and said inner edge of said lower horizontal member to make an airtight connection therewith, said right magnet is a magnet or a piece of ferromagnetic material that produces a magnetic field, said right magnet has a left edge, a right edge, an upper edge, a lower edge, an inner surface, an outer surface, an overall thickness, an overall height, an overall width, a longitudinal axis, a latitudinal axis, a vertical profile, and a horizontal profile, said outer surface of said right magnet is rigidly attached to said inner surface of said right vertical member of said frame, said left magnet is a magnet or a piece of ferromagnetic material that produces a magnetic field, said left magnet has a left edge, a right edge, an upper edge, a lower edge, an inner surface, an outer surface, an overall thickness, an overall height, an overall width, a longitudinal axis, a latitudinal axis, a vertical profile, and a horizontal profile, said outside surface of said left magnet is rigidly attached to said inner surface of said left vertical member of said frame, said right temple plate is a rigid planar ferromagnetic member attached to an arced, curved, or partial spherically shaped ferromagnetic member, wherein, said rigid planar ferromagnetic member of said right temple plate is a rigid planar member with a left edge, a right edge, an upper edge, a lower edge, an inner surface, an outer surface, a plane, a height, and a width, said rigid planar ferromagnetic member of said right temple plate is made of a ferromagnetic material, said arced, curved, or partial spherically shaped ferromagnetic member of said right temple plate is a two dimensional rigid arced, curved, or partial spherically shaped with an inner surface, an outer surface, a front edge, a rear tail, an upper edge, a lower edge, and an inner radius, said arced, curved, or partial spherically shaped ferromagnetic member of said right temple plate is made of a ferromagnetic material, said length of said outer edge of said rigid planar ferromagnetic member of said right temple plate is equal to said length of said front edge of said arced, curved, or partial spherically shaped ferromagnetic member of said right temple plate, and said right edge of said rigid planar ferromagnetic member of said right temple plate is rigidly attached to said front edge of said arced, curved, or partial spherically shaped ferromagnetic member of said right temple plate so that said plane of rigid planar ferromagnetic member of said right temple plate is perpendicular to said inner radius of arced, curved, or partial spherically shaped ferromagnetic member of said right temple plate, said left temple plate is a rigid planar ferromagnetic member attached to an arced, curved, or partial spherically shaped ferromagnetic member, wherein, said rigid planar ferromagnetic member of said left temple plate is a rigid planar member with a left edge, a right edge, an upper edge, a lower edge, an inner surface, an outer surface, a plane, a height, and a width, said rigid planar ferromagnetic member of left temple plate is made of a ferromagnetic material, said arced, curved, or partial spherically shaped ferromagnetic member of left temple plate is a two dimensional rigid arced, curved, or partial spherically shaped with an inner surface, an outer surface, a front edge, a rear tail, an upper edge, a lower edge, and an inner radius, said arced, curved, or partial spherically shaped ferromagnetic member of said left temple plate is made of a ferromagnetic material, said length of said outer edge of rigid planar ferromagnetic member of said left temple plate is equal to said length of said front edge of said arced, curved, or partial spherically shaped ferromagnetic member of said left temple plate, and said right edge of said rigid planar ferromagnetic member of said left temple plate is rigidly attached to said front edge of said arced, curved, or partial spherically shaped ferromagnetic member so that said plane of said rigid planar ferromagnetic member of said left temple plate is perpendicular to said inner radius of said arced, curved, or partial spherically shaped ferromagnetic member of said left temple plate, said helmet is hard or padded protective hat or headwear that is configured to be worn on a person's head;

said right temple plate is rigidly attached to said helmet; and said left temple plate is rigidly attached to said helmet.

* * * * *